US006918414B2

(12) United States Patent
Anada et al.

(10) Patent No.: US 6,918,414 B2
(45) Date of Patent: Jul. 19, 2005

(54) WEFT LENGTH MEASURING STORAGE UNIT

(75) Inventors: Masaru Anada, Ishikawa-ken (JP); Shinnichi Hongo, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 236 days.

(21) Appl. No.: 10/309,957

(22) Filed: Dec. 4, 2002

(65) Prior Publication Data

US 2003/0131900 A1 Jul. 17, 2003

(30) Foreign Application Priority Data

Dec. 27, 2001 (JP) ..... 2001-396592

(51) Int. Cl.[7] ..... D03D 47/36
(52) U.S. Cl. ..... 139/452
(58) Field of Search ..... 112/435.1; 139/452, 139/450, 116.2, 1 E, 1 R, 1 B, 1 D; 700/140, 143

(56) References Cited

U.S. PATENT DOCUMENTS 3,865,149 A 2/1975 Keidany
5,335,700 A * 8/1994 Ishido et al. ..... 139/435.1

FOREIGN PATENT DOCUMENTS

JP (2000) 11-147588 5/2000

* cited by examiner

*Primary Examiner*—Peter Nerbun
(74) *Attorney, Agent, or Firm*—The Webb Law Firm, P.C.

(57) ABSTRACT

A weft length measuring storage unit is characterized by comprising avoidance mechanism for setting said weft length measuring storage unit such that a weft is not measured its length or stored while maintaining operable one or more driven members which are driven by the main shaft of a loom to measure the weft or stored before the loom is at least inched or reversed.

12 Claims, 5 Drawing Sheets

WEFT LENGTH MEASURING STORAGE UNIT

BACKGROUND OF THE INVENTION

1. Field of the Invention

The present invention relates to a weft length measuring storage unit of a shuttleless loom, and in more particular, to a weft length measuring storage unit suitable for a fluid jet loom such as a water jet loom.

2. Description of Related Art

As one of weft length measuring storage units of water jet looms, there is an art of measuring the length and storing a weft by winding the weft around the periphery of an immovable drum by a yarn winding tube which is rotated along the periphery of the drum with the rotation of the main shaft of a loom. In this conventional art, the loom is inched or reversed after it is stopped, with the weft length measuring storage unit disconnected from the main shaft, and then the loom is operated again after synchronizing the weft length measuring storage unit with the main shaft.

As another art, there is a weft length measuring storage unit comprising a length measuring section for measuring the length of a weft nipped between a pair of length measuring rollers to be rotated in synchronization with a main shaft, and a storage section for storing by an air current the weft fed from the length measuring section until weft insertion is started. In this conventional art, generally after a loom is stopped, the length measuring rollers are separated from each other so as not to feed the weft when the loom is to be inched or reversed, and then when operation is to be resumed, the so-called synchronization to bring the length measuring rollers into contact with each other is made with the weft of a predetermined length stored.

There is still another length measuring storage unit comprising a length measuring section for measuring the length of a weft nipped between a pair of length measuring rollers, and a storage section for storing the weft fed from the length measuring section with the weft wound around the periphery of an immovable drum by a yarn guide. In this conventional art, one roller and a yarn guide are connected to a main shaft and rotated by the main shaft. Also, when performing an operation to pass the weft through the weft length measuring storage unit, an engagement pin is separated from the periphery of the immovable drum, and the length measuring rollers are separated from each other by pressing a button.

However, in the first prior art, a mechanism for disconnecting the weft length measuring storage unit and the main shaft as well as a mechanism for driving the weft length measuring storage unit for synchronization of the weft length measuring storage unit with the main shaft, etc., are required, which makes the unit large-sized.

In the latter two prior arts, if the looms are inched or reversed while the operation to separate the length measuring rollers is inadvertently neglected, there will arise such problems as an undesirable length measuring action is made to cause a weft newly pulled out of a weft package to wind around the length measuring rollers or to be pulled back toward the side of a weft inserting nozzle to come off the nozzle. Once such problems arise, it will take much time to get rid of the problems.

SUMMARY OF THE INVENTION

It is an object of the present invention to prevent a weft from winding around a weft length measuring storage unit and/or coming off a nozzle, which tend to occur in inching or reversing in the weft length measuring storage unit which is to be connected to the main shaft of a loom and driven.

The weft length measuring storage unit according to the present invention comprises an avoidance mechanism for setting the weft length measuring storage unit, before the loom is at least inched or reversed, such that the weft length is not measured nor stored while maintaining operable a driven member to be driven by the main shaft of the loom.

When a factor or a cause to stop the loom occurs, before inching or reversing, the driven member is maintained operable, but the weft length measuring storage unit is set such that the weft is not measured the length nor stored. By this, if inching or reversing is made while the loom is stopped, though the driven member is driven, such inconveniences as the weft winds around the weft length measuring storage unit in error or comes off the weft insert nozzle are prevented from happening.

The weft length measuring storage unit can comprise length measuring and storage machine for measuring the weft of the length of one pick during one turn of the main shaft and storing the measured weft until it is inserted.

The weft length measuring and storage machine can include: a pair of rollers for nipping to measure the length of the weft in cooperation, at least one of the rollers being rotated by the main shaft; an immovable drum immovably assembled into the loom; an engagement pin capable of advancing and retreating relative to the immovable drum so as to engage or disengage the weft; and a yarn guide rotated by the main shaft to wind the weft around the immovable drum. The driven member can include at least one of the two rollers and the yarn guide, and the avoidance mechanism can include means for separating both the rollers so as to release the nipped weft, and means for retreating the engagement pin so as to prevent the weft from being engaged.

In place of this, the weft length measuring storage machine may include a pair of rollers for nipping the weft in cooperation to measure the length thereof, at least one of the rollers being rotated by the main shaft; the driven member may include at least one of the two rollers; and the avoidance mechanism may include means for separating the rollers so as to release the nipped weft.

The weft length measuring storage machine may comprise an immovable drum assembled immovably into the loom; an engagement pin capable of advancing and retreating relative to the immovable drum so as to engage and disengage the weft; and a yarn guide to be rotated by the main shaft to wind the weft around the immovable drum. The driven members may include the yarn guide, and the avoidance mechanism may include means for retreating the engagement pin so as to prevent the weft from being engaged.

Before the loom is at least inched or reversed, it is possible to make the avoidance mechanism set the weft length measuring storage unit such that the weft is not measured the length nor stored, while maintaining the driven member operable by the main shaft, during a period from generation of a loom stop signal attributable to occurrence of a cause to stop the loom till immediately before the loom is inched or reversed.

The above-mentioned period can be selected from a group including: when the loom is inertially rotating, when the inertial rotation is stopped, and when operation for inching or reversing is performed.

The avoidance mechanism can include: an avoidance instruction section for generating an avoidance instruction signal instructing to set the weft length measuring storage unit to be such that the weft is not measured the length nor stored, while maintaining the driven member operable by the main shaft; and one or more electric actuator for driving an avoidance member for setting the weft length measuring storage unit, upon receipt of the avoidance instruction signal, such that the weft is not measured the length nor stored.

PREFERRED EMBODIMENT OF THE INVENTION

Figure 1:
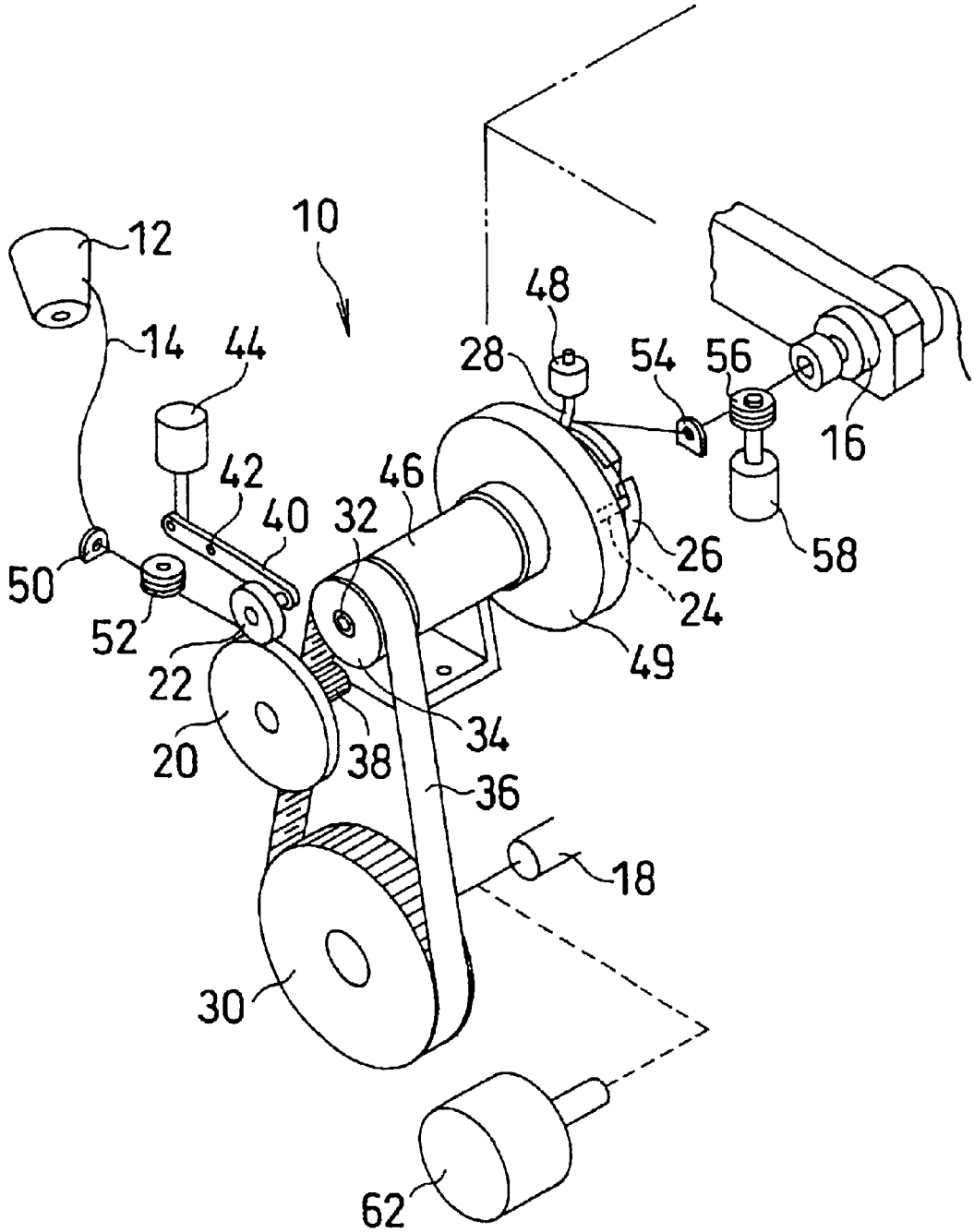
FIG. 1 is a perspective view showing an embodiment of the weft length measuring storage unit according to the present invention.

Referring to FIG. 1, the weft length measuring storage unit 10 is used for a water jet loom which inserts a weft 14 extending from a weft package 12 into a warp shed from a weft insert nozzle 16 together with the water to be jetted from the weft insert nozzle 16.

The weft length measuring storage unit 10 comprises: a length measuring section which feeds and measures the weft 14 from the weft package 12 in a state of being nipped between a pair of length measuring rollers 20, 22 connected to a main shaft 18 of the loom and rotated synchronously with the main shaft 18; and a storage section for storing the measured weft 14 by an engagement pin 28 until the next weft insertion with the measured weft 14 wound around the outer periphery of an immovable drum 26 by a yarn guide 24 connected and rotated synchronously with the main shaft 18.

Rotation of the main shaft 18 is transmitted to a hollow shaft portion 32 by a pulley 30 connected to the main shaft 18, a pulley 34 assembled into a shaft portion 32 of the yarn guide 24, and an endless belt 36 stretched over both the pulleys, as well as to one of the rollers 20 by a pulley 38 engaged with the endless belt 36.

In the illustration, the pulleys 30, 34 and 38 are timing pulleys such as a timing gear, and the endless belt 36 is a timing belt. In place of each timing pulley, however, a sprocket, a flat pulley, a V-pulley or the like may be used, while in place of the timing belt, a chain, a flat belt, a V-belt or the like may be used.

One of the length measuring rollers 20 is connected to the pulley 38 which meshes with a belt so as to function as a drive roller to be rotated upon receipt of the torque of the main shaft 18.

The other length measuring roller 22 is rotatably supported at one end of a lever 40 so as to function as a driven roller to be rotated following the rotation of the drive roller 20. The lever 40 is supported at an intermediate portion in its longitudinal direction so as to oscillate about a pivot, i.e., a fulcrum 42.

The lever 40 is also driven to make the driven roller 22 selectively contact or separate from the drive roller 20 so as to make the length measuring rollers 20, 22 selectively nip or release the weft 14.

The yarn guide 24 is supported at its shaft portion 32 so as to rotate around a support case 46. The immovable drum 26 is attached to a cover 49 assembled into the support case 46. The engagement pin 28 is disposed on the outer periphery of the immovable drum 26 so as to selectively engage and disengage the weft 14 and is selectively advanced or retreated by an electric actuator 48 such as an electromagnetic solenoid.

Each member of the weft length measuring storage unit 10 is supported on a frame not shown in such a state as mentioned above. Detailed explanation of the weft length measuring storage unit 10 is omitted here, because the structure thereof is described in the Official Gazette of Japanese Patent Appln. Public Disclosure (KOKAI) No. 2000-336551 or the like.

The weft 14 from the weft package 12 is nipped between the rollers 20, 22 through a first fixed guide 50 and a fixed damper 52, is measured to have the length of one pick by the rotation of the rollers 20, 22, and fed to the storage section. The first clamper 52 is intended to prevent the weft from moving from the weft package 12 to the length measuring section and is driven by an electromagnetic solenoid not shown so as to release the weft 14 when necessary such as during operation (weaving) or when threading into the weft length measuring storage unit 10.

The measured weft 14 reaches the front end of the yarn guide 24 through the shaft portion 32 of the yarn guide 24, wound around the periphery of the immovable drum 26 over the length of one pick by the rotation of the yarn guide 24 so as to be stored until the next weft insertion.

The weft 14 further extends from the storage section through the second fixed guide 54 and the second damper 56 into a weft insert nozzle 16. The second damper 56 catches hold of the weft 14 on the upstream side of the weft insert nozzle 16 and releases the weft 14 during the weft insertion, driven synchronously with the electric actuator 58.

While weaving by the loom, the electric actuator 44 drives the lever 40 so as to nip the weft 14 between the length measuring rollers 20, 22, and the electric actuator 48 drives the engagement pin 28 so as to release the stored weft 14 at the start of the weft insertion and engage the weft 14 at the end of the weft insertion.

The weft 14 extending from the weft package 12 is measured the length, nipped between the length measuring rollers 20, 22, even during the weft insertion. Thus, while running, particularly in the latter half of the running, there occurs so-called constrained running in which the running of the weft 14 is constrained by the length measuring roller 20, 22, slackening of the weft is settled. Therefore, the weft length measuring storage unit 10 is advantageous for strong twisted weft fabric.

When a loom stop signal for stopping the loom is generated due to the occurrence of a cause to stop such as end breaking, the loom is stopped after inertial rotation, and thereafter, the loom is reversed or inched to solve the cause of the stoppage, that is, to proceed with reparation. When the cause of the stoppage is solved, the loom is restarted after a preliminary step for operation so as to resume the weaving motion.

Upon generation of a loom stop signal, the electric actuator 44 separates the driven-side roller 22 from the drive-side roller 20, the electric actuator 48 retreats the engagement pin 28 from the immovable drum 26, and the electric actuator 58 makes the second damper 56 hold the weft 14.

The above-mentioned setting of the electric actuators 44, 48, 58 is done during the period from the generation of the loom stop signal until immediately before the loom is inched or reversed. Such a period can be selected from: during the inertial rotation of the loom, the stopped state of the inertial rotation, and the time of inching or reversing operation.

By this, the weft length measuring storage unit 10 is set such that, even if the loom is reversed or inched, length measurement and storing of the weft 14 is not performed. Such a setting can be done, based on a so-called loom control signal for controlling the loom stop signal, a signal by a push-button, an operation state signal, a timing signal, and the like.

Even if the electric actuators 44, 48, 58 are set as mentioned above, the drive-side roller 20 and the yarn guide 24 are connected to the main shaft 18 and, therefore, maintained to be rotatable by the main shaft. Consequently, when the loom is reversed or inched, the roller 20 and the yarn guide 24 are reversed or inched.

During the inching or reversing of the loom, however, even if the roller 20 and the yarn guide 24 are reversed or inched, since the driven-side roller 40 had been separated from the drive-side roller 20 and the engagement pin 48 is retreated; the length measuring and storage of the weft 14 are not performed; therefore, neither pulling the weft 14 out of the weft package 12 nor pulling back of the weft 14 from the weft insert nozzle 16 is carried out, thereby preventing such inconveniences as the weft 14 winds around the length measuring storage unit 10 in error or comes off the weft insert nozzle 16.

Figure 2:
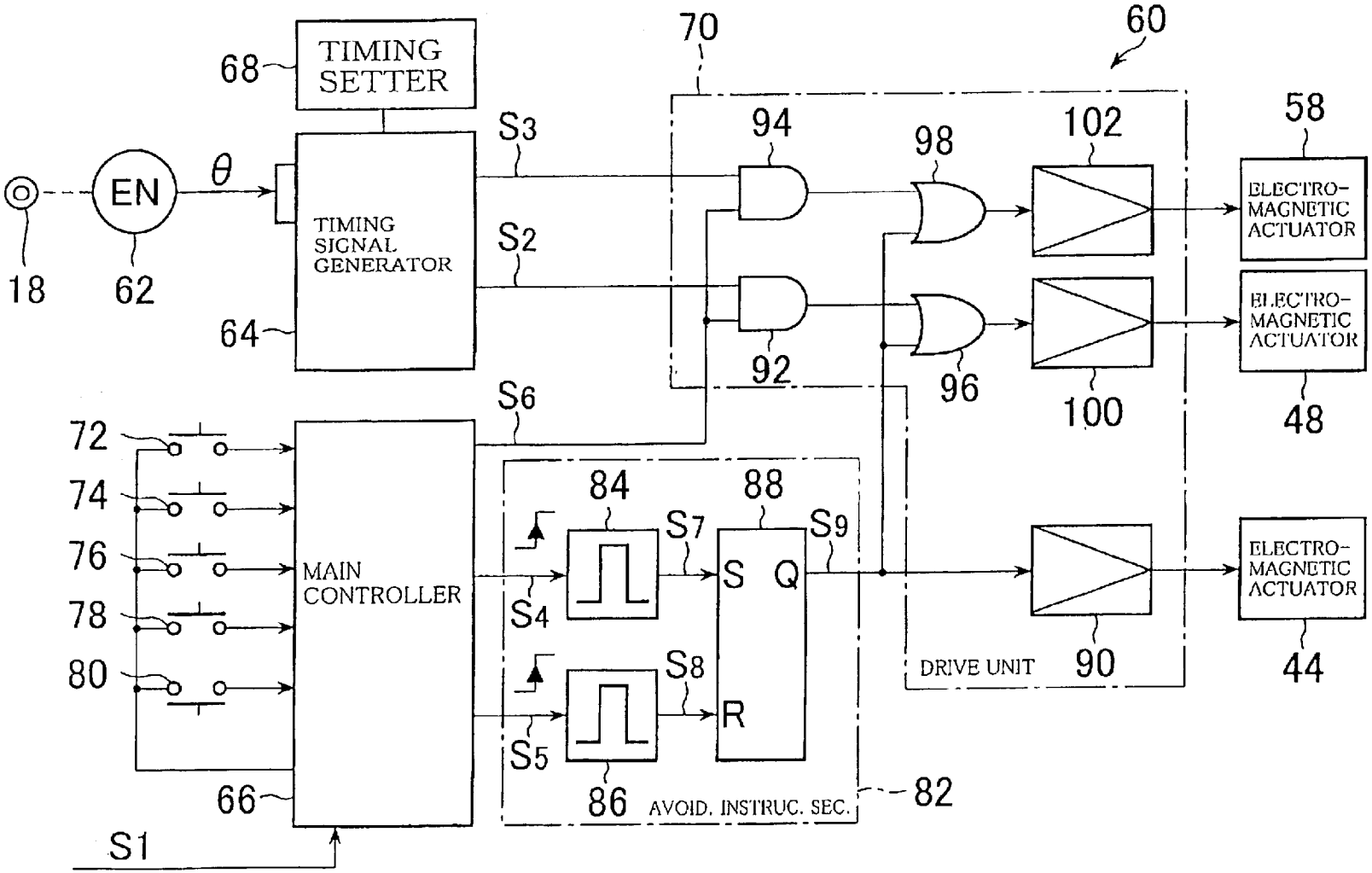
FIG. 2 is a block diagram of an electric circuit showing an embodiment of a controller for the weft length measuring storage unit in FIG. 1.

Such a control of the weft length measuring storage unit 10 is performed by the controller 60 shown in FIG. 2.

Referring to FIG. 2, the controller 60 receives at a timing signal generator 64 an output signal of an angle detector 62 which, by detecting the rotational angle of the main shaft 18, generates a corresponding angle signal θ, and receives a loom stop signal S1 attributable to a failure in weft insertion, end breaking or the like at a main controller 66.

The timing signal generator 64 reads, on the basis of the angle signal θ to be inputted from the angle detector 62, from the timing signal setter 68 set timing for driving the electric actuators 48 and 58 for the engagement pin 28 and the second clamper 56 in FIG. 1 and outputs as timing signals S2 and S3 to the drive unit 70.

In the timing setter 68, the timings for driving the electric actuators 48 and 58 are preset. For example, when beating timing is set at 0°, the timings for driving the electric actuators 48 and 58 can be respectively set at values to turn on between 100° and 230° as well as between 100° and 250°. Thereby, the engagement pin 28 disengages the weft 14 retreated from the immovable drum 24 and stored, and the second damper 56 releases the weft 14 extending to the weft insert nozzle 16.

The main controller 64 is connected to a plurality of press button switches for manually inputting various instructions such as an operation preparation button 72 for making the loom prepare for operation, an operation button 74 for activating the loom, an inching button 76 for inching the loom, a reversing button 78 for reversing the loom, a stop button 80 for stopping the loom, etc.

The main controller 66 outputs various signals for operating or stopping the loom according to various preset data such as the loom stop signal S1, press button instruction, weaving parameters, etc., to a warp feeder, a cloth take-up controller, a main shaft controller, a picking device, a shedding device, etc., which are not shown. This brings each machine and device of the loom to an operation preparing state, an operating state (weaving state) or a stopped state.

Among the various signals to be outputted from the main controller 66, the stop signal S4 and an operation preparation signal S5 are fed to an avoidance instruction section 82, while an operating state signal S6 is fed to a drive unit 70.

Figure 3:
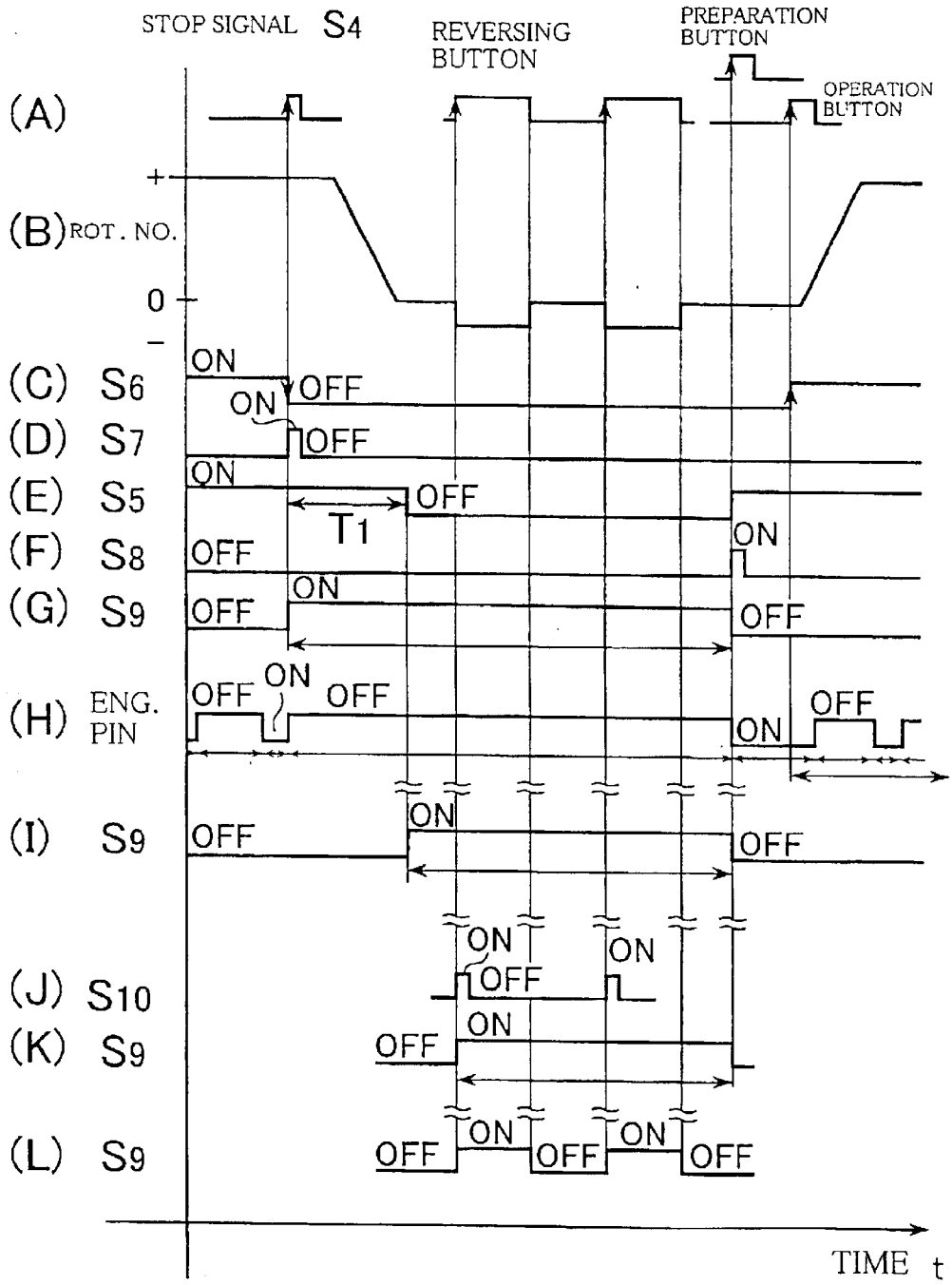
FIG. 3 is a schematic view showing a waveform of an electric signal in the controller in FIG. 2.

The stop signal S4 is, as shown in FIG. 3(A), an instruction signal for actually stopping the loom is turned on for a short time by inputting of the loom stop signal S1 to the main controller 66 or pressing down of a stop button 80. When the stop signal S4 for "ON" is generated, the loom and its respective machines and devices are stopped after inertial rotation.

The operation preparation signal S5 is an instruction signal which is, as shown in FIG. 3(E), turned on when the cause of the stoppage is repaired and an operation preparation button 72 is pushed down to be kept ON until a predetermined time T1 elapses after the generation of the stop signal S4. Concretely, the operation preparation signal S5 turns on during preparation for operation and during operation, and turns off after the loom is stopped. When the operation preparation signal S5 for ON is generated, each machinery of the loom resumes its operation to prepare for weaving so as to reactivate the loom.

The operating state signal S6 is a signal for indicating whether the loom is in the operating state or the stopped state, and as shown in FIG. 3(C), is kept ON while the loom is operating (in weaving state) and OFF while it is stopped. That is to say, the ON output of the operating state signal S6 corresponds to the operating state of the loom, while the OFF output thereof corresponds to the stoppage of the loom.

An avoidance instruction section 82 receives the stop signal S4 in a pulse generator 84 and the operation preparation signal S5 in a pulse generator 86. The pulse generator 84, as shown in FIG. 3(D), being triggered upon rising of an input signal, generates a signal S7 which is kept on for a predetermined time. The pulse generator 86, as shown in FIG. 3(F), being triggered upon rising of the input signal, generates a signal S8 which is kept on until the operation preparation button 72 is pushed down.

The output signal S7 of the pulse generator 84 is fed to a set input terminal of a flip-flop 88, and the output signal S8 of the pulse generator 86 is fed to a reset input terminal of the flip-flop 88. Therefore, the flip-flop 88 is, as shown in FIG. 3(G), set by the generation of the stop signal S4 and reset by pushing down of the preparation button 72.

A Q-output (set output) of the flip-flop 88 is fed to a drive unit 70 and a drive circuit 90 as an avoidance instruction signal S9 for setting the weft length measuring storage unit 10 such that the weft is not measured the length or stored. The avoidance instruction signal S9 is kept ON while measurement of the weft length by the length measuring rollers and the engagement of the weft by the engagement pin should be prevented.

While the avoidance instruction signal S9 for ON is inputted, the drive circuit 90 drives the electric actuator 44 for the driven roller to separate both length measuring rollers. This makes the weft extending from the weft package released from the length measuring rollers, so that the measurement of the weft length is hindered, thereby to prevent the weft from winding around the immovable drum and being stored.

The drive unit 70 receives the timing signal S2 for driving the engagement pin at one of the input terminals of an AND circuit 92, receives the timing signal S3 for driving the second damper at one of the input terminals of an AND circuit 94, and receives the operating state signal S6 at the other input terminals of both the AND circuits 92, 94.

The AND (logical product) output signals of the AND circuits 92 and 94 are respectively fed to one of input terminals of OR circuits 96 and 98. The OR circuits 96 and 98 receive the avoidance instruction signal S9 at the other of the input terminals and output OR signals of both the input signals respectively to drive circuits 100 and 102.

The drive circuit 100 drives the electric actuator 48 for the engagement pin while the input signals are ON to retreat the engagement pin from the immovable drum. The drive circuit 102 drives the electric actuator 58 for the second damper while the input signals are ON and releases the weft from the second damper.

In the following is explained the motion of the controller 60 in the case where, by the timing as shown in FIG. 3(A), the stop signal S4 is generated and the reversing button, the operation preparation button and the operation button are respectively pushed down.

When weaving, the operation state signal S6 is ON and the avoidance instruction signal S9 is OFF. Therefore, the drive circuit 90 drives the electric actuator 44 for the length measuring rollers so as to have the length measuring rollers nip the weft. By this, the weft extending from the weft package is measured the length by the length measuring rollers and wound around the immovable drum.

Further, the drive circuits 100 and 102 respectively make the electric actuators 48 and 58 drive at predetermined timings as set in the timing setter 68. Thereby, the engagement pin engages and disengages the weft, as shown in FIG. 3(H), according to the timings set in the timing setter 68, and the second damper performs holding and releasing of the weft according to the timings set in the timing setter 68.

Upon generation of the stop signal S4, the operation state signal S6 turns off as shown in FIG. 3(C), and the output signal S7 of the pulse generator 84 is kept ON for a short time as shown in FIG. 3(D), so that the flip-flop 88 is set and the avoidance instruction signal S9 obtained by its Q-output turns on as shown in FIG. 3(G).

As a result of the above, the drive circuit 90 drives the electric actuator 44 for the length measuring rollers such that the length measuring rollers do not nip the weft. For this reason, the weft extending from the weft package is released from the nipped state by the measuring rollers not to be measured the length.

Further, when the avoidance instruction signal S9 turns off, both AND circuits 92, 94 are closed, so that the drive circuits 100 and 102 drive the electric actuators 48 and 58 respectively by the avoidance instruction signal S9 for ON to be inputted through the OR circuits 96 and 98 so as to have the weft disengaged from the engagement pin and held by the second clamper. By this, the engagement pin turns off and disengages the weft as shown in FIG. 3(H), and the second damper releases the weft.

When the reversing button 78 is pushed down in the above-mentioned state, the main shaft 18 is reversed while the reversing button 72 is pushed down. When the inching button 76 is pushed down in place of the reversing button 78, the main shaft 18 is normally rotated or reversed by a predetermined angle every time the inching button 76 is pushed down.

Since the weft extending from the weft package is not held by the length measuring rollers even when either the reversing button 78 or the inching button 76 is pushed down, the weft is not pulled out of the weft package nor wound around the immovable drum, nor pulled back from the weft insert nozzle.

A cause for stopping is solved by an operator, reversing or inching the loom by manually operating a predetermined button as mentioned above. Since at this time the drive roller and the yarn guide are rotated by the main shaft 18, there is no fear that the phase of the drive roller and the yarn guide with respect to the main shaft would change, thereby facilitating the work for repairing the cause for stopping.

When the cause for stopping is solved and the operation preparation button 72 is pushed down, the output signal S8 of the pulse generator 86 is kept ON for a short time as shown in FIG. 3(F), so that the flip-flop 88 is reset, and the avoidance instruction signal S9 obtained by its Q-output turns off as shown in FIG. 3(G).

By this, the drive circuits 100 and 102 respectively drive the electric actuators 48 and 58 by predetermined timings set in the timing setter 68. By this, the engagement pin performs engaging and disengaging the weft as shown in FIG. 3(H) by the timings set in the timing setter 68, and the second damper performs holding and releasing the weft by the timings set in the timing setter 68. Since at this time the phase of the drive roller and the yarn guide with respect to the main shaft is not changed, there is no need to synchronize them.

The electric actuator 58 can be driven so that, while the loom is reversed or inched, the second damper may release the weft. This facilitates threading into the length measuring storage unit 10. However, if the weft comes off the nozzle because of being released, the held state may be kept until released manually as heretofore.

As mentioned above, by using the avoidance instruction signal S9 from when the stop signal S4 turns on (during the inertial rotation) till when the operation preparation button 72 is pushed down, it is possible to prevent the length measuring, winding and coming off the nozzle of the weft even during the inertial rotation of the loom.

However, in place of making the avoidance instruction signal S9 such as above, it is possible to turn the operation instruction signal S5 on from its rising (after the loom stops) till the operation preparation button 72 is pushed down, as shown in FIG. 3(I). In this case, the flip-flop 88 is set at the start of the operation preparation signal S5 and reset by pushing down of the operation preparation button 72.

Also, as shown in FIG. 3(K), the avoidance instruction signal S9 may be a signal to be kept ON from when the reversing button 78 (or inching button 78) is pushed down till when the operation preparation button 72 is pushed down. In this case, the flip-flop 88 is set by a reversing pulse S10 (or inching signal) shown in FIG. 3(J) because the reversing button 78 (or inching button 78) is pushed down first and reset by pushing down the operation preparation button 72. However, such avoidance instruction signal S9 may be generated without using the flip-flop but by logically reversing the operation preparation signal S5.

Further, as shown in FIG. 3(L), the avoidance instruction signal S9 may be a signal which is kept ON while the reversing button 78 is pushed down and the main shaft 18 is reversed (or inched). In this case, the flip-flop 88 is set by the reversing pulse S10 (or inching signal) shown in FIG. 3(J) due to pushing down of the reversing button 78 (or inching button 78), and reset when the loom is stopped. Such avoidance instruction signal S9, however, may be generated without using the flip-flop but by utilizing the reverse signal or inching signal outputted from the main controller 66.

The timing to turn off the avoidance instruction signal S9 is not limited to such a timing as mentioned above but can be an arbitrary timing from termination of the reversing or inching till the operation is resumed.

Figure 4:
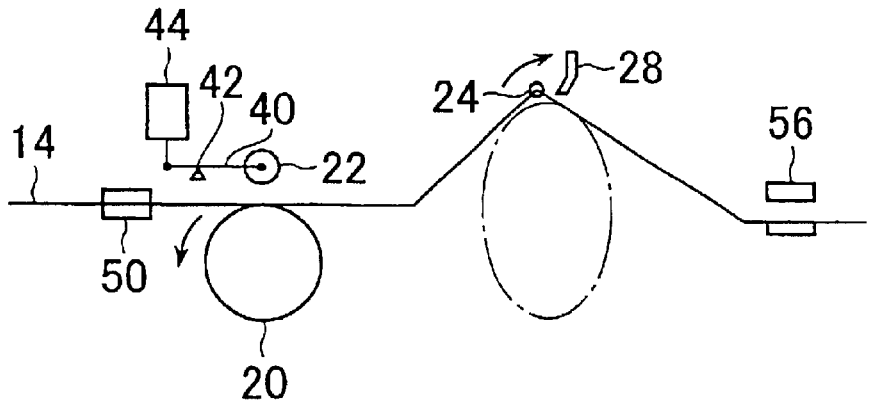
FIG. 4 is a view to explain an action when the loom in the weft length measuring storage unit in FIG. 1 is reversed.

The motion of the weft length measuring storage unit 10 during the reversing of the loom is shown in FIG. 4. In FIG. 4, the second damper 56 is not holding the weft 14.

While the loom is reversed, the rollers 20, 22 are separated and the engagement pin 28 does not engage the weft 14, so that, even if the drive roller 20 and the yarn guide 24 are reversed together with the main shaft, the weft is not returned to the side of the first damper 50, nor pulled back from the weft insert nozzle, nor fed to the side of the storage section, nor wound around the drive roller 20 and/or the immovable drum.

For the same reason as above, when the loom is inched, even if the drive roller 20 and the yarn guide 24 are inched together with the main shaft, the weft is not measured the length, nor wound around the drive roller 20 and the immovable drum, nor pulled back from the weft insert nozzle.

In the weft length measuring storage unit 10, the drive roller 20 and the yarn guide 24 to be rotated and driven by the main shaft 18 act as driven members, while the driven roller 22 and the engagement pin 28 act as avoidance members.

However, it is possible to omit the length measuring rollers 20, 22, in the length measuring storage unit 10, and have the yarn guide 24 act as a driven member and have the engagement pin 28 act as an avoidance member. In this case, the yarn guide 24 and the immovable drum 26 cooperate to work as a length measuring section and a storage section.

In the embodiment shown in FIG. 1, it is possible to omit the length measuring rollers 20, 22, and to measure the length of the weft 14 and store the weft 14 by winding around the outer periphery of the drum 26 by the rotation of the yarn guide 14.

Also, in the embodiment shown in FIG. 1, a clutch may be interposed between the main shaft and one of the drive systems, i.e., the rollers and the yarn guide to be driven by the main shaft, whereby the clutch, when turned off before the loom is inched or reversed, works as avoidance mechanism which does not make the loom actuate. In other words, in case there are a plurality of members to be driven by the main shaft within the length measuring storage unit, it is possible to constitute at least one member as a driven member to be driven by the main shaft and the other members as avoidance mechanism.

Figure 5:
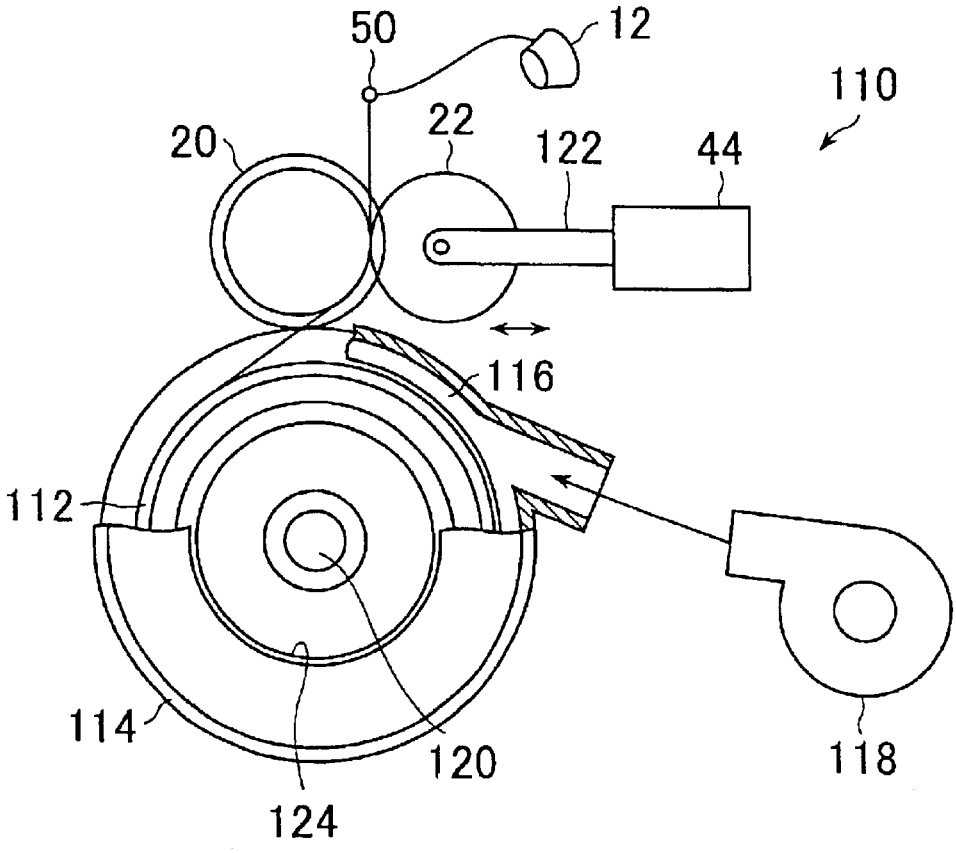
FIG. 5 is a partially broken front elevation showing another embodiment of the weft length measuring storage unit according to the present invention.
Figure 6:
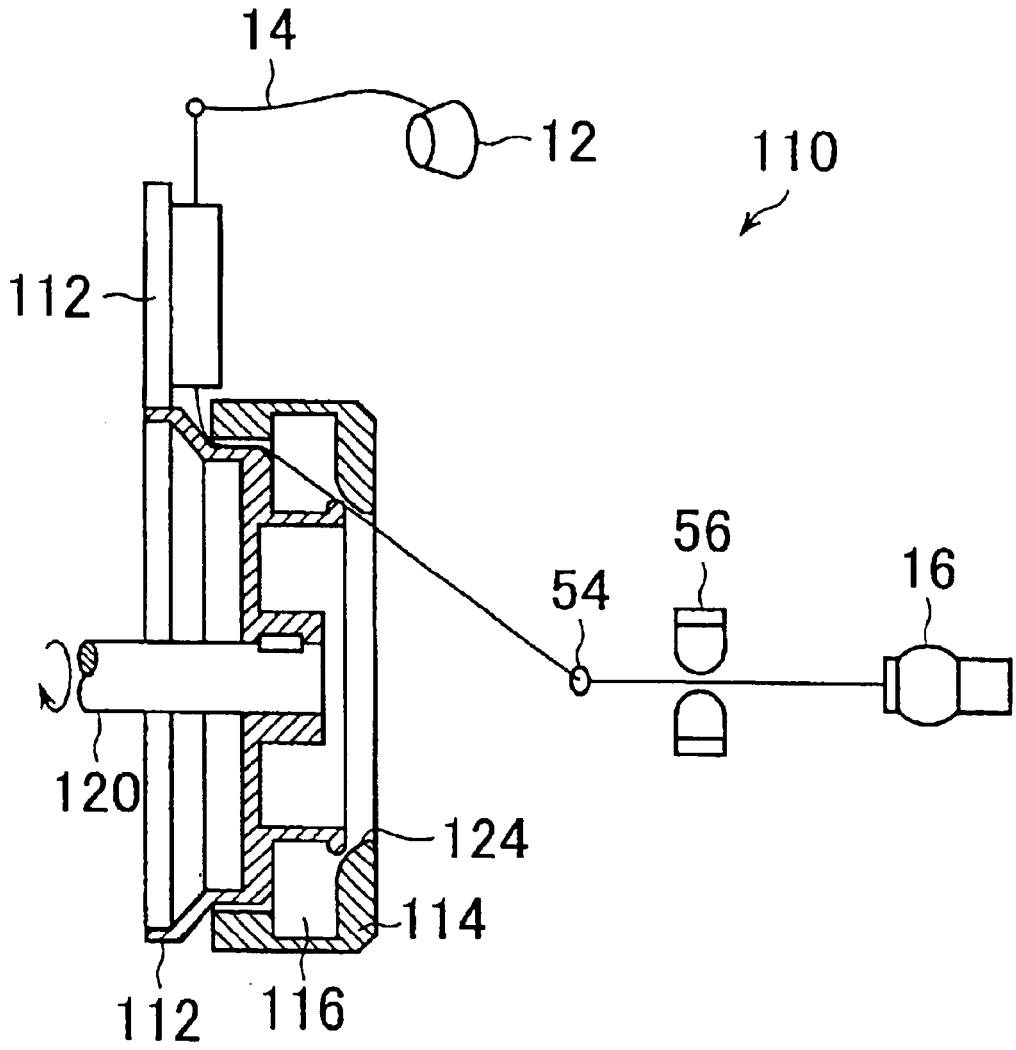
FIG. 6 is a vertical section of the weft length measuring storage unit shown in FIG. 5.

Referring to FIGS. 5 and 6, a weft length measuring storage unit 110 uses a rotating drum type storage section in place of an immovable drum type storage section.

The rotating drum type storage section includes: a rotating drum 112 assembled rotatably into the loom; a cover 114 surrounding the circumference of the rotating drum 112; and an air current generator 118 such as a blower to blow the air into an annular flow path 118 between the outer periphery of the rotating drum 112 and the inner periphery of the cover 114.

The rotating drum 112 is assembled into a shaft portion 120 to be rotated by the main shaft of the loom and, therefore, is rotated together with the main shaft. The cover 114 and the air current generator 116 are supported on the frame of the loom.

The drive roller 20 in contact with the outer periphery of the rotating drum 112 is driven by the rotation of the rotating drum 112, and measures the length of the weft 14 in cooperation with the driven roller 22. The driven roller 22 is rotatably supported at the front end of a support arm 122 advanced or retreated by the electric actuator 44, and separated relative to the drive roller 20 by the electric actuator 44.

The rotating drum type storage section generates by the air current generator 118 whiling air current whirling in the same direction as the rotating drum 112 in an annular path 116 between the rotating drum 122 and the cover 114 and stores the weft 14 along the outer periphery of the rotating drum 112 by this annular air current.

The stored weft 14, whose front end is ejected from the weft insert nozzle 16 together with fluid, is pulled out through the opening 124 of the cover 114. The second damper 56 holds the weft 14 while storing it and releases the weft during weft insertion.

Since the structure of the weft length measuring storage unit 110 using the rotating drum type storage section is also described in Japanese Patent Appln. Public Disclosure (KOKAI) No. 2000-336551, detailed description is omitted here.

In the weft length measuring storage unit 110, the rotating drum 112 and the drive roller 20 act as driven members, and the driven roller acts as an avoidance member.

Also in the weft length measuring storage unit 110, when a cause of stoppage occurs to the loom, the rotating drum 112 and the drive roller 20 are maintained operable before the loom is inched or reversed, and the driven roller 22 is separated from the drive roller 20. By this, the weft length measuring storage unit 110 is set such that the weft 14 is not measured the length or stored.

As a result of the above, in the weft length measuring storage unit 110, too, if inching or reversing occurs while the loom is stopped, even though the driven member is driven, such troubles as the weft winds around the length measuring storage unit or comes off the weft insert nozzle by accident are prevented.

In the present invention, instead of using the electric actuator such as a solenoid, another actuator such as a mechanism to be mechanically driven to advance and retreat may be used.

The present invention can be applied not only to a device for winding a weft around a drum to store but also to a device storing a measured weft by carrying it on linear air current for storage in a linear storage section, such as a device described in Japanese Patent Appln. Public Disclosure (KOKAI) 49-48956.

The present invention can be applied not only to a water jet loom but also to an air jet loom. Furthermore, the present invention can be applied not only to a weft insert loom for a single color but to a multicolor weft insert loom. When applying the present invention to a multicolor weft insert loom, a weft storage device having avoidance mechanism is provided for each kind of yarn.

The present invention is not limited to the foregoing embodiments but can be modified variously without departing from its spirit.

What is claimed is:

1. A weft length measuring storage unit comprising:

a driven member to be driven by a main shaft of a loom and participating in measuring and storing the weft; and an avoidance mechanism for setting the weft length measuring storage unit such that the weft length is not measured or stored even when said driven member is operable by said main shaft.

2. A weft length measuring storage unit as described in claim 1, further comprising;

an immovable drum assembled into the loom; and an engagement pin capable of advancing and retreating relative to said immovable drum so as to engage or disengage the weft;

wherein said driven member is a yam guide to be rotated by the main shaft of the loom to wind the weft around said immovable drum; and wherein said avoidance mechanism retreats said engagement pin before the loom is at least inched or reversed so that, even when said yarn guide is operable by said main shaft, the weft may not be stored on said immovable drum by the rotation of said main shaft.

3. A weft length measuring storage unit as described in claim 1, wherein said driven member is a length measuring roller to be rotated by the main shaft of the loom and to measure the length while making the rotation of said length measuring roller act on the weft; and wherein said avoidance mechanism sets such that, at least before the loom is inched or reversed, the rotation of said length measuring roller by the rotation of said main shaft does not act on the weft even when said length measuring roller as the driven member is operable by said main shaft.

4. A weft length measuring storage unit as described in claim 1, wherein the period before the loom is at least inched or reversed includes a period from the time of generation of a loom stop signal due to occurrence of a cause of stopping until immediately before inching or reversing of the loom.

5. A weft length measuring storage unit as described in claim 1, wherein the period before said loom is at least inched or reversed includes a period from the time of generation of a loom stop signal due to occurrence of a cause of stopping until immediately before inching or reversing of the loom, and wherein the latter period is selected from a group including: during inertial rotation of the loom, while said inertial rotation is stopped, and the time during inching or reversing operations.

6. A weft length measuring storage unit as described in claim 1, wherein said avoidance mechanism includes: an avoidance instruction section for generating an avoidance instruction signal for instructing to set said weft length measuring storage unit such that the weft length is not measured or stored; and at least one electric actuator for driving an avoidance member which sets said weft length measuring storage unit such that the weft length is not measured or stored, upon receipt of said avoidance instruction signal.

7. A weft length measuring storage unit as described in claim 2, wherein the period before said loom is at least inched or reversed includes a period from the time of generation of a loom stop signal due to occurrence of a cause of stopping until immediately before inching or reversing of the loom.

8. A weft length measuring storage unit as described in claim 2, wherein the period before said loom is at least inched or reversed includes a period from the time of generation of a loom stop signal due to occurrence of a cause of stopping until immediately before inching or reversing of the loom, and wherein the latter period is selected from a group including: during inertial rotation of the loom, while said inertial rotation is stopped, and the time during inching or reversing operations.

9. A weft length measuring storage unit as described in claim 2, wherein said avoidance mechanism includes: an avoidance instruction section for generating an avoidance instruction signal for instructing to set said weft length measuring storage unit such that the weft length is not measured or stored; and at least one electric actuator for driving an avoidance member which sets said weft length measuring storage unit such that the welt length is not measured or stored, upon receipt of said avoidance instruction signal.

10. A weft length measuring storage unit as described in claim 3, wherein the period before said loom is at least inched or reversed includes a period from the time of generation of a loom stop signal due to occurrence of a cause of stopping until immediately before inching or reversing of the loom.

11. A weft length measuring storage unit as described in claim 3, wherein the period before said loom is at least inched or reversed includes a period from the time of generation of a loom stop signal due to occurrence of a cause of stopping until immediately before inching or reversing of the loom, and wherein the latter period is selected from a group including: during inertial rotation of the loom, while said inertial rotation is stopped, and the time during inching or reversing operations.

12. A weft length measuring storage unit as described in claim 3, wherein said avoidance mechanism includes: an avoidance instruction section for generating an avoidance instruction signal for instructing to set said weft length measuring storage unit such that the weft length is not measured or stored; and at least one electric actuator for driving an avoidance member which sets said weft length measuring storage unit such that the weft length is not measured or stored, upon receipt of said avoidance instruction signal.

* * * * *

UNITED STATES PATENT AND TRADEMARK OFFICE

CERTIFICATE OF CORRECTION

PATENT NO. : 6,918,414 B2
DATED : July 19, 2005
INVENTOR(S) : Anada et al.

It is certified that error appears in the above-identified patent and that said Letters Patent is hereby corrected as shown below:

Column 11,
Line 7, “is a yam guide” should read -- is a yarn guide --.

Column 12,
Line 23, “the welt length” should read -- the weft length --.

Signed and Sealed this

Twenty-fourth Day of January, 2006

JON W. DUDAS
*Director of the United States Patent and Trademark Office*